United States Patent [19]

Hertel et al.

[11] Patent Number: 5,054,262

[45] Date of Patent: Oct. 8, 1991

[54] AUTOMATED CORRUGATED BOX PROCESSING EQUIPMENT

[75] Inventors: Philip G. Hertel, 4313 Grace Ct., Rohnert Park, Calif. 94928; James D. DuVander, Santa Rosa; Michael K. Jewett, Windsor, both of Calif.

[73] Assignee: Philip Graham Hertel, Rohnert Park, Calif.

[21] Appl. No.: 424,520

[22] Filed: Oct. 20, 1989

[51] Int. Cl.[5] ..... B65B 7/20; B31B 1/14

[52] U.S. Cl. ..... 53/381.1; 53/382.1; 493/361; 493/465

[58] Field of Search ..... 493/340, 352, 361, 364, 493/369, 465; 53/381 R, 382

[56] References Cited

U.S. PATENT DOCUMENTS

| | | | |
|---|---|---|---|
| 3,373,543 | 3/1968 | Migrelli et al. | 53/381 R |
| 3,387,522 | 6/1968 | Standley | 53/381 R |
| 3,533,214 | 10/1970 | Standley | 53/374 |
| 4,291,518 | 9/1981 | Johnson | 53/381 R |
| 4,293,086 | 10/1981 | Fincher et al. | 53/381 R |
| 4,317,320 | 3/1982 | Nigrelli | 53/374 |

OTHER PUBLICATIONS

Advertising circular of Five X Corporation entitled Tab Breaker (not dated).

*Primary Examiner*—William E. Terrell

*Attorney, Agent, or Firm*—Limbach, Limbach & Sutton

[57] ABSTRACT

A device for the releasing of tabs found on the diagonally facing corners of tab-locked corrugated cardboard boxes. The boxes are moved along a track whereupon they are deformed to enable a release means positioned along the track to slip between major flap and the sidewall of the corrugated box to release a first tab. The box is then turned at least 90° and the process repeated.

30 Claims, 3 Drawing Sheets

AUTOMATED CORRUGATED BOX PROCESSING EQUIPMENT

TECHNICAL FIELD OF THE INVENTION

The present invention involves a device for the releasing of tabs located on the diagonal corners of tab-locked corrugated boxes. Although tab locks are conveniently employed to keep the major and minor flaps of corrugated cardboard boxes in place during box filling and processing, there has not been, to date, a convenient means of breaking or cutting such tabs at the appropriate point in the processing facility.

BACKGROUND OF THE INVENTION

FIG. 2 shows a typical tab-locked corrugated box 10 having major flaps 11*a* and 11*b* and minor flaps 12*a* and 12*b*. The major and minor flaps are held tightly to the sides of the corrugated cardboard box by small tabs 13*a* and 13*b* of cardboard which is not removed during the die cutting operation when box 10 was manufactured.

The use of these now widely available tab-locked corrugated boxes adds greatly to the efficiency of the production line. Tab-locked boxes eliminate the need for flap controls on conventionally employed uncasing and case packing machines as well as on the conveyor system. Generally, cardboard boxes of this nature are filled with product through the use of a vertical case packer. Again, when using tabs, such packers require no flap control devices. In fact, no flap control is required anyplace in the processing line until the tabs are broken just prior the case sealer.

Unfortunately, there has not been a device for the efficient cutting or breaking of tabs and giving control of the major and minor flaps. Prior devices have included mechanical expedients to rip the tabs apart by lifting the major and minor flaps of these boxes. Such an operation can easily damage the case and result in a ragged flap edge where the tabs appeared. Further, vacuum devices have been employed where suction cups have been drawn to the flap surfaces and pulled to again physically break the tabs just prior to the sealing operation. Even in this case, however, the flat edges are aesthetically imperfect and the supporting hardware necessary in establishing the required vacuum proved cumbersome and unreliable. To complicated matters, such devices have proven most inadequate when dealing with damp or wet boxes which are most often encountered in high humidity areas. In such a condition, the boxes tend to deform rather than facility a clean tab release. Prior devices have even employed knives, but they have been held in a stationary or moving but fixed orientation to the box and, as a result, have not proven reliable in entering the space between the flap and box to cut the tab. Such devices also were incapable of compensating for boxes of varying widths and would, at times, cut the box flaps themselves rather than just the tabs.

It is thus an object of the present invention to provide a device for the releasing of tabs currently found on the diagonally facing corners of tab-locked corrugated cardboard boxes while avoiding the limitations found in prior art devices.

It is yet a further object of the present invention to provide a device for the releasing of tabs on even cardboard boxes that are deformed.

These and further objects will be more readily apparent when considering the following disclosure and appended claims wherein FIG. 1 represents a perspective view of an production line track employing the present invention.

FIG. 2, as noted previously, represents a perspective view of a standard tab-locked corrugated box which is processed by the invention shown in FIG. 1.

SUMMARY OF THE INVENTION

The present invention deals with a device for the releasing of tabs found on diagonally facing corners of tab-locked corrugated cardboard boxes. Such boxes are provided with major and minor flaps having first and second tabbed and non-tabbed corners whereby the tabs act to retain the flaps against the cardboard boxes.

Means are provided for moving a corrugated cardboard box along a track with either the major or minor flaps of the cardboard box being parallel to the track's longitudinal axis and the tabbed first corner of the corrugated box being upstream and first non-tabbed corner of the corrugated box being downstream along the longitudinal axis.

A first deforming means such as a protrusion is located on the track in position so that the downstream corner of the corrugated box across from the first non-tabbed corner passes over a second box deformation means such as a second protrusion to temporarily deform the cardboard box resulting in a separation of the major or minor flap from the box sidewall at its first non-tabbed corner. A first releasing means is provided which is moveably positioned along the track and biased toward the cardboard box such that the releasing means is capable of passing between the major or minor flap and cardboard box at the first non-tabbed corner whereupon the first tab is either cut or broken as the box passes the releasing means along the track.

The present device is further provided with means for turning the cardboard box either approximately 90° or approximately 180° along the track whereupon it encounters a second deforming means such as a second protrusion which is positioned so that the downstream corner of the cardboard box located across from the non-tabbed corner passes over it which causes the box to again temporarily deform. This deformation results in a separation of the major or minor flap from the cardboard box at the second non-tabbed corner. A second releasing means is again moveably positioned along the track, is biased toward the cardboard box, and is capable of passing between the major or minor flap and box at the second non-tabbed corner. As the box passes the releasing means, the second tab is cut or broken.

The present invention further contemplates downstream processing means capable of urging the flaps which have now been freed from their tabs upwardly in anticipation of engaging a box sealing device.

DETAILED DESCRIPTION OF THE INVENTION

Figures 1, 2, 3:
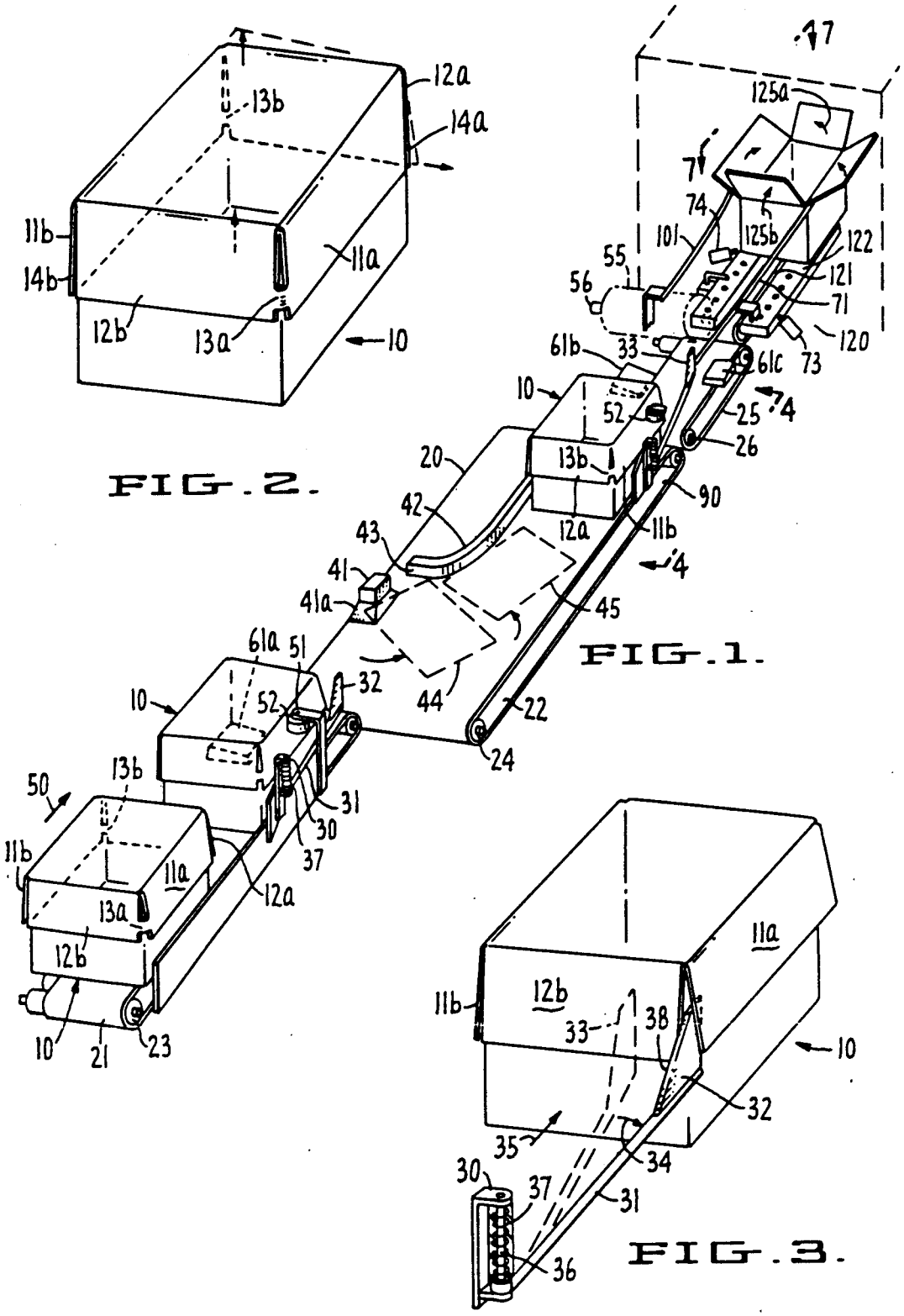
FIG. 3 is a perspective view of only that portion of the present invention embracing releasing means for releasing those tabs shown in FIG. 2
Figure 4:
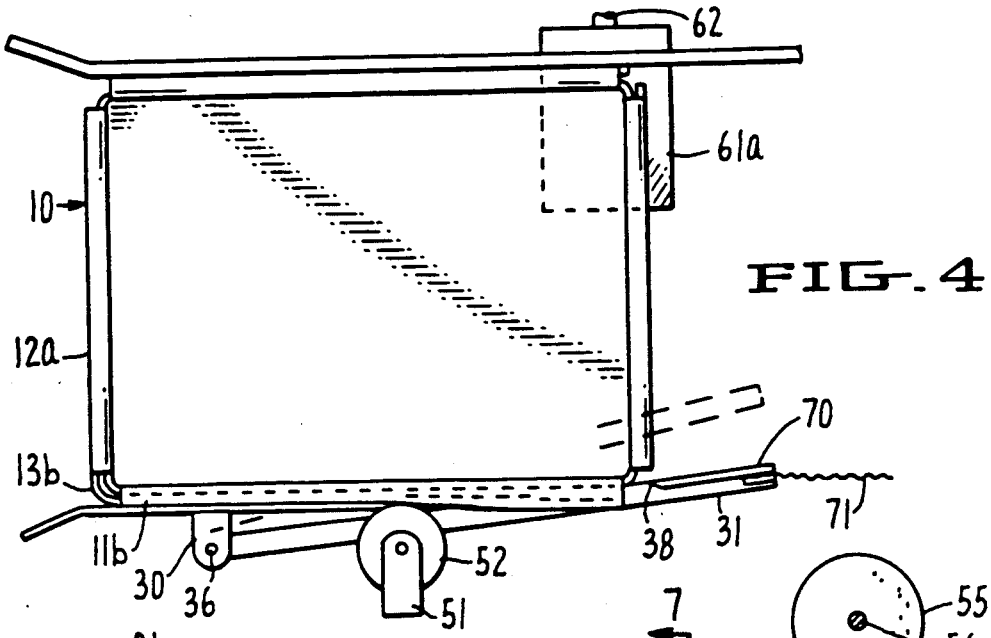
FIG. 4 is a top elevational view taken approximately at the first releasing station shown in FIG. 1.

Reference is made to FIG. 1 which shows, virtually the entire invention, in perspective. As illustrated, corrugated box 10 is first introduced to the moving track which, in this illustration, is a moving belt powered on rollers 23. Box 10 moves in the direction of arrow 50 with major flap 11*a* being parallel to the track's longitudinal axis and the tabbed first corner 13*a* being upstream and first non-tabbed corner 14*a* being downstream along said longitudinal axis. Alternatively, if the tabs were so situated, one of the box's minor flaps could have been shown as being parallel to the track's longitudinal axis.

Figure 6:
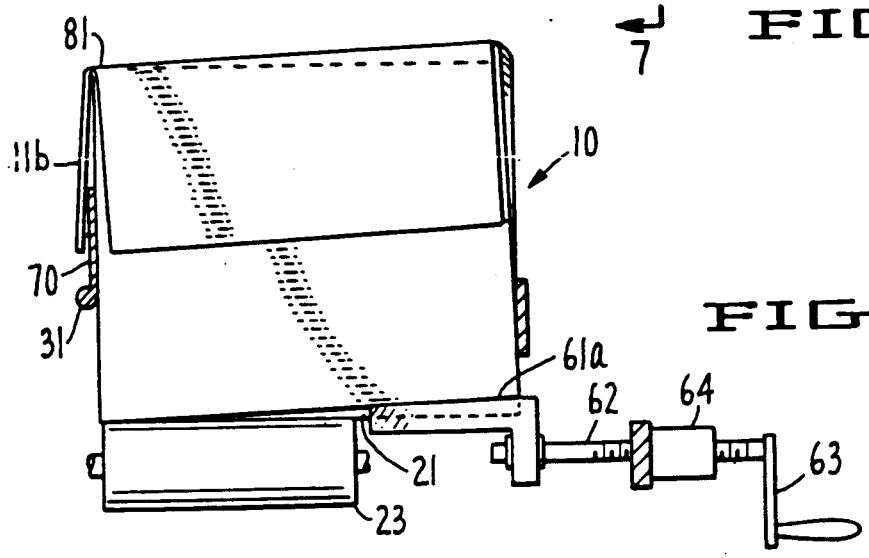
FIG. 6 is a front elevational view of a typical cardboard box taken along the assembly track shown in FIG. 1.

A first means for deforming box 10 is illustrated as protrusion 61*a* shown in phantom in FIG. 1 and in more detail in FIG. 6. It is to be emphasized that any expedient could be employed to facilitate deformation of the box while remaining within the scope of the present invention. The first deformation means, such as protrusion 61*a* is located on the track and positioned so that the downstream corner of cardboard box 10 across from first non-tabbed corner 14*a* passes over first protrusion 61*a* which is sized and positioned to temporarily deform the cardboard box as shown in FIG. 6 resulting in a separation of major flap 11*a* from the cardboard box at first non-tabbed corner 14*a*. Deformation means 61*b* is also provided to facilitate the release of a second tab at second releasing means 90.

As further illustrated in FIG. 6, protrusion 61*a* is located beneath the top surface of endless moving belt 21 and is capable of having its position adjusted along the track to accommodate cardboard boxes of different widths. Although an endless belt is shown, virtually any means of moving box 10 downstream can be employed—the use of an endless belt is merely one expedient. In this illustration, protrusion 61*a* is functionally engaged to shaft 62 which is threaded and channeled within mating support 64. As such, when crank 63 is turned, protrusion 61*a* can be moved to either the left or right of FIG. 6 thus accommodating cardboard boxes of varying widths. A similar configuration is employed later in the assembly which functions identically to protrusion or deforming means 61*a* discussed herein.

As noted previously, the function of protrusion 61*a* is to raise the corner opposite non-tabbed corner 14*a* which deforms cardboard box 10 resulting: in flap 11*a* being lifted from the sidewall of box 10. This facilitates the passage of first releasing means 32 between major flap 11*a* and cardboard box 10 at corner 14*a*.

As seen in FIG. 3, as a preferred embodiment, the releasing means of the present invention comprises a releasing plate in a substantially vertical orientation supported by a substantially horizontally extended arm 31 which is in turn supported by a vertically extending peg 36. Contained within support structure 30 is biasing means 37 which biases horizontally extended arm 34 toward cardboard box 10 as shown by phantom structure 33. The biasing means can be a mechanical spring as shown or similar expedient such as an air spring with rate control or hydraulic control or even an elastomeric material. When corrugated cardboard box 10 is caused to travel in the direction of arrow 35, corner 14*a* comes into contact with horizontally extending member 31 causing the support for releasing plate 32 to travel in the direction of arrow 34. The releasing plate, which is supported generally at the height of tab 13*a* engages the contact results in a clean severing of the tab.

Figure 5:
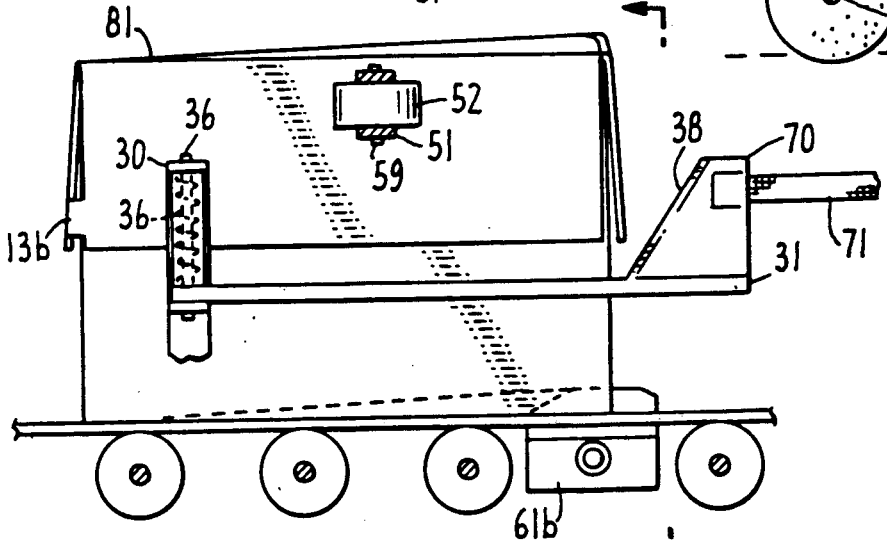
FIG. 5 is a side elevational view taken along segment 4—4 of FIG. 1.

To further facilitate the release of tab 13*a*, it is contemplated that the device of the present invention be provided with means for increasing friction between box 10 and the track beneath the box when the cuts are made. This is done both when the first and second releasing means act to cut or break tabs 13*a* and 13*b*. This configuration is best shown in FIG. 5 where, as a preferred embodiment, wheel means 55 is rotably positioned about shaft 56 such that the top 81 of cardboard box 10 engages wheel means 55 which applies pressure to top 81. This increases friction which helps to keep the box moving on tracks 21 and 25 while the first and second releasing means engage their tabs. This is particularly advantageous as it eliminates the tendency for the plates to drag the box rather than making clean and sharp tab breaks. The friction increasing means can take on a number of configurations while remaining within the spirit of the present invention. As such, a spongy cylindrically shaped member can be extended over the entire box surface. Alternatively, a plastic drape can extend over the tracks to confront the boxes at the appropriate moment.

As yet a further embodiment, to additionally assist in lifting major flap 11*a* at non-tabbed corner 14*a*, it is contemplated that wheel means 52 which is rotably supported on a substantially vertical axis 59 and support 51 contact major or minor flap as shown in FIGS. 1 and 5. The application of a slight degree of pressure by rotatable wheel means 52 proximate where the flap joins the box results in the tendency for the flap to lift away from cardboard box 10 at corner 14*a*.

It is seen, again, by viewing FIG. 1 that after first releasing means 32 is caused to release tab 13*a*, the box must be rotated to enable a second releasing means to release tab 13*b*. Although the figure shows rotating box 10 approximately 180°, the device of the present invention could effect only a single 90° rotation if the placement of the tabs or other circumstances or requirements so dictate. It is only in the turning of cardboard box 10 that both first and second releasing means can be placed on the same side of moveable belts 21 and 22.

Ideally, corrugated cardboard box 10 is turned approximately 180° by providing obstructions 41 and 42 whereby box 10, upon hitting obstruction 41 turns approximately 90° while the same box, when engaging rail 42 at obstruction point 43 turns a second 90°. As such, the box is then positioned so that second releasing means 90 can release tab 13*b* in a manner virtually identical to that described above regarding the use of the first releasing means in cutting or breaking tab 13*a*.

To further facilitate turning, obstruction 41 can be provided with skirt 41*a* which acts to raise the corner of the box which contacts the skirt and move the box's center of friction. This facilitates the box's rotation.

Although various obstructions are shown as elements 41/41*a*, 42 and 43 as ideal means for facilitating box rotation, any comparable means can be employed to effect rotation. For example, a parallel belt can be used traveling at a rate of be employed to effect rotation. For example, a parallel belt can be used traveling at a rate of speed which differs from the speed of belt 22. Such dual speed tracks could be employed to cause box rotation.

The first and second releasing means differ from one another only in providing guide means 71 emanating from second releasing means 90 (FIG. 5). As such, the second releasing means also acts in conjunction with protrusion 61*b* which performs just as protrusion 61*a* upon cardboard box 10.

Figure 8:
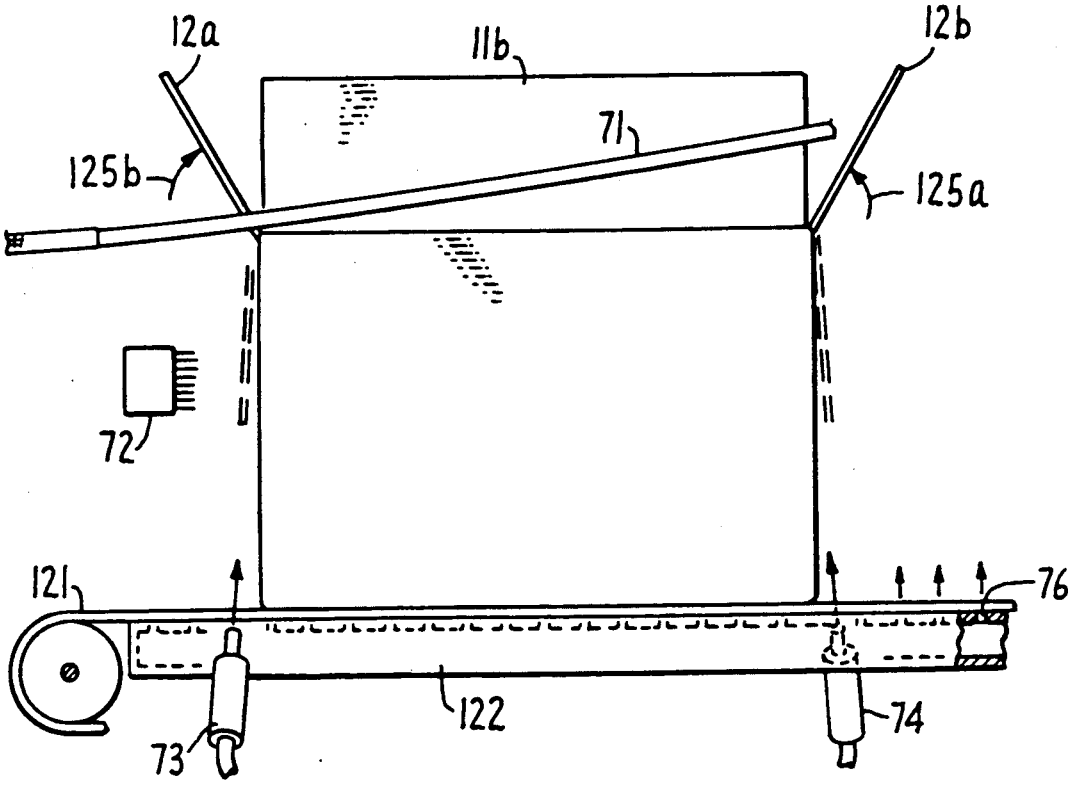
FIG. 8 is a side elevational view taken along the assembly track of FIG. 1 approximately in the position of processing as shown in FIG. 7.

As noted above, emanating from second releasing plate 70 is guide means 71. As best shown in FIG. 8, guide means 71, which is ideally a flexible cord having a slight upward slope, engages below flap 11*b* which is raised as guide 71 is ramped upwardly. Obviously, first guide means 71 should be sufficiently flexible so as to not prevent second releasing means 90 from being biased as shown. A corresponding ramp 101 can be provided opposite ramp 71 in order to facilitate the lifting of flap 11*a*. To assist ramp 101 in entering between flap 11*a* and the box, third deforming means 61*c* is provided downstream of such deforming means 61*b* and on the opposite side of the track as the second deforming means. This is done to facilitate the feeding of cardboard box 10 to the case sealer.

Figure 7:
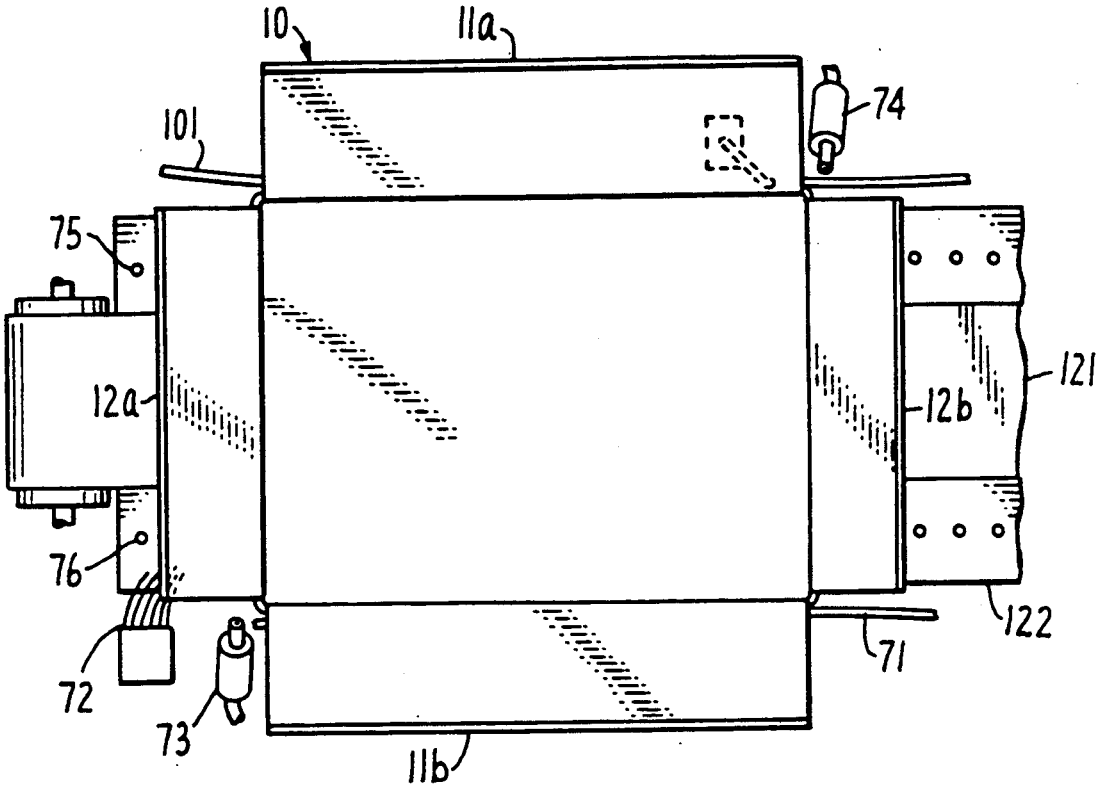
FIG. 7 is a top elevational view taken approximately at segment 7—7 of the assembly track shown in FIG. 1.

As yet another preferred embodiment, provision is made to also raise flaps 12*a* and 12*b*. As shown in FIGS. 7 and 8, cardboard box 10 is caused to enter processing area 120 whereby moveable belt 121 passes over surface 122. Because belt 121 is reduced in width in comparison to belts 21, 22 and 25, a portion of surface 122 is exposed thus revealing rows of holes 75 and 76 for directionally and sequentionally expelling air between flaps 13*a* and 13*b* moving them in the direction of arrows 125*a* and 125*b* (FIG. 8). Surface 122 can be part of a pressurized plenum or merely a support for holes 75 and 76.

As yet a further expedient, brush means 72 is positioned as shown in FIGS. 7 and 8 which engages the sidewall of box 10 and catches on upstream flap 13*b* causing it to raise, again, the direction of arrow 125*b*.

Finally, air jet means 73 and 74 can be further employed as yet an additional expedient for insuring the raising of both major and minor flaps.

It is contemplated that the device of the present invention can be completely self-contained and employed as an add-on unit to be used with preexisting cardboard box filling lines. In using this device, lines can employ tab lock cases which, as noted previously, eliminates the need for any flap control throughout the packing and indexing operations. The present invention not only is capable of releasing the box tabs but of facilitating flap raising for the feeding of filled boxes to the downstream case sealer section of the assembly line.

We claim:

1. A device for the releasing of tabs found on diagonally facing corners of tab-locked corrugated cardboard boxes, said cardboard boxes having major and minor flaps having first and second tabbed and non-tabbed corners whereby said tabs act to retain said flaps against said cardboard boxes comprising:

A. means for moving a corrugated cardboard box along a track with either a major or minor flap of the cardboard box being parallel to the track's longitudinal axis and the tabbed first corner of the corrugated box being upstream and first non-tabbed corner of the corrugated box being downstream along said longitudinal axis;

B. a first deforming means located on said track and positioned so that the downstream corner of said cardboard box across from said first non-tabbed corner passes over said first deformation means which is sized and positioned to temporarily deform said cardboard box resulting in a separation of the flap from the cardboard box at the first non-tabbed corner thereof;

C. first releasing means positioned along said track and biased toward said cardboard box such that said releasing means is capable of passing between the flap and cardboard box at the first non-tabbed corner and of releasing the first tab as the cardboard box passes said releasing means;

D. means for turning the cardboard box at least approximately 90° along said track;

E. a second deforming means located on said track and positioned so that the downstream corner of said cardboard box located across from the second non-tabbed corner passes over said second deformation means which is sized and positioned to temporarily deform said cardboard box resulting in a separation of the flap from the cardboard box at the second non-tabbed corner thereof; and F. second releasing means positioned along said track and biased toward said cardboard box such that said releasing means is capable of passing between the flap and cardboard box at said second non-tabbed corner and of releasing the second tab as the cardboard box passes said releasing means.

2. The device of claim 1 wherein said means for moving said cardboard box at least approximately 90° comprises at least one obstruction capable of turning said cardboard box approximately 90°.

3. The device of claim 2 wherein said cardboard box is moved approximately 180° by two obstructions, each capable of turning said cardboard box approximately 90°.

4. The device of claim 1 wherein said means for moving said corrugated box along said track comprises one or more endless moving belts.

5. The device of claim 4 wherein said first and second deforming means are protrusions which are each located beneath the top surface of said endless moving belt.

6. The device of claim 1 wherein said first and second releasing means are each comprised of a releasing plate held above said track at a height of approximatley the height of each tab, said releasing plate being supported by a substantially horizontally extended arm biased to a substantially vertically extending peg.

7. The device of claim 6 wherein said first and second protrusions are each capable of having their positions adjusted along the track to accommodate cardboard boxes of differing widths.

8. The device of claim 1 further comprising means for increasing friction between said cardboard box and track while said first and second releasing means act to release said tabs.

9. The device of claim 8 wherein said means for increasing friction comprises wheel means rotatably positioned on shafts such that the top of each cardboard box engages the surface of each wheel to substantially prevent a shift in box positioning on said track while said first and second releasing means act to release said tabs.

10. The device of claim 1 whereby means are provided for applying pressure to the flaps located proximate said first and second releasing means near where said flaps join said box to further urge said flaps from said box.

11. The device of claim 1 wherein first guide means are provided which extend from said second releasing means for lifting the flap located proximate said second releasing means up and away from the cardboard box.

12. The device of claim 11 wherein second guide means are provided which extend across said track from said first guide means for lifting the flap located on the opposite side of the cardboard box which is proximate said second releasing means.

13. The device of claim 12 further comprising third deforming means located downstream and on the opposite side of the track from the second deforming means to facilitate entry of second guide means between a flap and the box.

14. The device of claim 11 wherein said first guide means comprises flexible cord which is sufficiently flexible so as to not impair the ability of said second releasing means to be biased toward said box.

15. The device of claim 1 further comprising means for raising the flaps of the cardboard box up and away from the cardboard box.

16. The device of claim 15 wherein said means for raising the flaps comprises brush means located along said track positioned to catch a free edge of the upstream flap and to lift it away from the cardboard box.

17. The device of claim 15 wherein said means for raising the flaps comprise means for directionally and sequentially expelling air between the flaps and cardboard box.

18. The device of claim 17 wherein said means for directionally expelling air comprises a pressurized plenum and openings on the top surface thereof for expelling air on both sides of said track.

19. The device of claim 18 wherein said means for moving said cardboard box at least approximately 90° comprises one or more obstructions, each capable of turning said cardboard box approximately 90°.

20. The device of claim 18 wherein said means for increasing friction comprises wheel means rotatably positioned on shafts such that the top of each cardboard box engages the surface of each wheel to substantially prevent a shift in box positioning on said track while said first and second release means act to release said tabs.

21. A device for the releasing of tabs found on diagonally facing corners of tab-locked corrugated cardboard boxes, said cardboard boxes having major and minor flaps having first and second tabbed and non-tabbed corners whereby said tabs act to retain said flaps against said cardboard boxes comprising:

A. means for moving a corrugated cardboard box along the track with a flap of the cardboard box being parallel to the track's longitudinal axis and a tabbed first corner of the corrugated box being upstream and first non-tabbed corner of the corrugated box being downstream along said longitudinal axis;

B. a first deformation means located on said track and positioned so that the downstream corner of said corrugated box across from said first non-tabbed corner passes over said first deformation means which is sized and positioned to temporarily deform said cardboard box resulting in a separation of the flap from the cardboard box at the first non-tabbed corner thereof;

C. first release means positioned along said track and biased toward said cardboard box such that said release means is capable of passing between the flap and the cardboard box at the first non-tabbed corner and of releasing the first tab as the cardboard box passes said release means;

D. means for turning the cardboard box at least approximately 90° along said track;

E. a second deformation means located on said track and positioned so that the downstream corner of said cardboard box located across from the second non-tabbed corner passes over said second deformation means which is sized and positioned to temporarily deform said cardboard box resulting in a separation of the flap from the cardboard box at the second non-tabbed corner thereof;

F. second release means positioned along said track and biased towards said cardboard box such that said release means is capable of passing between the flap and cardboard box at said second non-tabbed corner and of releasing the second tab as the cardboard box passes said release means;

G. means for increasing friction between said cardboard box and track while said first and second release means act to release said tabs;

H. first guide means extending from said second release means for lifting the flap located proximate said second release means up and away from said cardboard box; and I. means for raising the flaps up and away from said cardboard box located downstream of said second release means.

22. The device of claim 21 wherein said means for moving said corrugated box along said track comprises one or more endless moving belts.

23. The device of claim 21 wherein said first and second release means are each comprised of a releasing plate held above said track at a height of approximately the height of each tab, said releasing plate being supported by a substantially horizontally extended arm biased to a substantially vertically extending peg.

24. The device of claim 21 wherein said first and second deformation means are protrusions which are each located beneath a top surface of said endless moving belt.

25. The device of claim 24 wherein said first and second protrusions are each capable of having their positions adjusted along the track to accommodate cardboard boxes of differing widths.

26. The device of claim 21 wherein said first guide means comprises flexible cord which is sufficiently flexible so as not to impair the ability of said second knife means to be biased toward said box.

27. The device of claim 21 wherein said means for raising the flaps comprises brush means located along said track positioned to catch a free edge of the upstream flap to lift it away from the cardboard box.

28. The device of claim 21 wherein said means for raising the flaps comprise means for directionally expelling air between the flaps and cardboard box.

29. The device of claim 28 wherein said means for directionally expelling air comprises a pressurized plenum and openings on the top surface thereof for expelling air on both sides of said track.

30. A method for the releasing of tabs found on diagonally facing corners of tab-locked corrugated cardboard boxes, said cardboard boxes having major and minor flaps having first and second tabbed and non-tabbed corners whereby said tabs act to retain said flaps against said cardboard boxes comprising:

A. moving a corrugated box along a track with a flap of the cardboard box being parallel to the track's longitudinal axis and the tabbed first corner of the corrugated box being upstream and first non-tabbed corner of the corrugated box being downstream along said longitudinal axis;

B. passing said cardboard box over a first deformation located on said track and positioned so that the downstream corner of said cardboard box across from said first non-tabbed corner passes over said deformation means which is sized and positioned to temporarily deform said cardboard box resulting in a separation of the flap from the cardboard box at the first non-tabbed corner thereof;

C. passing a first release means between the flap and cardboard box at the first non-tabbed corner and releasing said first tab as the cardboard box passes said release means;

D. turning said cardboard box at least approximately 90° along said track;

E. passing said cardboard box over a second deformation means which is located on said track and positioned so that the downstream corner of said cardboard box located across from the second non-tabbed corner passes over said second protrusion which is sized and positioned to temporarily deform said cardboard box resulting in a separation of the flap from the cardboard box at the second non-tabbed corner thereof; and F. passing a second release means between the flap and cardboard box at said second non-tabbed corner and releasing the second tab as the cardboard box passes said release means.

* * * * *